US005261754A

United States Patent [19]

Sugiura

[11] Patent Number: 5,261,754

[45] Date of Patent: Nov. 16, 1993

[54] PAPER FEEDING DEVICE IN A PRINTER

[75] Inventor: Toshiaki Sugiura, Hekinan, Japan

[73] Assignee: Brother Kogyo Kabushiki Kaisha, Nagoya, Japan

[21] Appl. No.: 901,847

[22] Filed: Jun. 22, 1992

[30] Foreign Application Priority Data

Aug. 1, 1991 [JP] Japan ..... 3-216432

[51] Int. Cl.[5] ..... B41J 13/02

[52] U.S. Cl. ..... 400/636.3; 400/636; 271/274

[58] Field of Search ..... 400/636, 636.3, 636.1, 400/637, 637.1, 637.3, 624, 625; 271/274

[56] References Cited

U.S. PATENT DOCUMENTS

| | | | |
|---|---|---|---|
| 4,212,554 | 7/1980 | Gelling | 400/636 |
| 4,522,520 | 6/1985 | Takenoya et al. | 400/636.3 |
| 4,683,480 | 7/1987 | Sakamoto et al. | 400/636 |
| 4,823,942 | 4/1989 | Martin et al. | 361/212 |
| 4,878,772 | 11/1989 | Fukumoto et al. | 400/636.3 |
| 4,898,488 | 2/1990 | Yokoi et al. | 400/642 |
| 5,005,028 | 4/1991 | Tamura et al. | 400/120 |
| 5,018,889 | 5/1991 | Oyaide et al. | 400/642 |
| 5,087,642 | 2/1992 | Seki et al. | 523/152 |

FOREIGN PATENT DOCUMENTS

| | | | |
|---|---|---|---|
| 62-263079 | 11/1987 | Japan | 400/636 |
| 2-303872 | 12/1990 | Japan | 400/636.3 |

*Primary Examiner*—Edgar S. Burr
*Assistant Examiner*—Ren Yan
*Attorney, Agent, or Firm*—Oliff & Berridge

[57] ABSTRACT

A feeding device for a printer having a combination of at least one feeding roller with an opposing pinch roller both upstream and downstream, in the feed direction, of a print position. The upstream and downstream side paper feeding rollers are made from metal and the upstream and downstream pinch rollers are made of a elastic material. The upstream and downstream side paper feeding rollers feed a paper sandwiched between the feeding rollers and opposing pinch rollers. The nip pressure on the downstream side is slightly stronger than the nip pressure on the upstream side so that the feed rate is slightly higher at the downstream side than at the upstream side. As a result, the paper is tant as it moves past the print position. Further, the paper is accurately positioned for each line, even after the paper has cleared than nip of the upstream side paper feeding and pinch rollers.

21 Claims, 3 Drawing Sheets

PAPER FEEDING DEVICE IN A PRINTER

BACKGROUND OF THE INVENTION

1. Field of the Invention

The invention relates to a precise paper feeding device in a printer.

2. Description of Related Art

There is a conventional printer using a serial scan printing method by which a reciprocatable printing head installed on a carriage prints a printing line during each scan of the carriage. With this kind of printer, after the printing head prints the printing line, the carriage immediately returns to the start of the line. The moment the carriage returns, a predetermined amount of paper is fed.

Conventionally, in this kind of a printer, the paper is fed by rotating a pair of paper feeding rollers. The paper is sandwiched between a pair of paper feeding rollers, installed on the upstream and downstream sides of the paper feeding direction of the printing head, and rotatable pinch rollers in a predetermined pressure contact with each of the feeding rollers. In this case, since the feeding power of the paper is determined by the frictional force of the paper and the paper feeding rollers, the paper feeding rollers are generally comprised of an elastic member such as rubber which has a high coefficient of friction with a paper.

However, as a predetermined amount of a paper must be fed for each printing line to properly space the lines of printed characters or Figures, when the paper feeding amount is not accurate, a second printing line is to close to or partially overlayed onto the preceding printing line or extra space is created between the printing line and the preceding printing line. The result is an unattractive print job.

Because the paper feeding accuracy is important, particularly in printing pictures or Figures, a paper feeding accuracy of tens of microns might be demanded. However, it was difficult to produce a paper feeding roller, made from an elastic member like rubber, with high accuracy in order to achieve the desired precise paper feeding.

If the opposing pressure of the pinch rollers is increased to reduce the paper feeding amount, and the frictional force of the paper becomes stronger, the paper feeding rollers are distorted because the paper feeding rollers are made from an elastic member. As a result, the paper feeding accuracy becomes unstable. On the contrary, if the opposing pressure of the pinch rollers is weakened to increase the paper feeding amount, and the frictional force of the paper becomes weaker, insufficient frictional force is obtained and the paper feeding accuracy again becomes unstable.

Further, if the paper feeding amount of the downstream side paper feeding rollers is less than that of the upstream side paper feeding rollers, the paper becomes loose between the downstream side paper feeding rollers and the upstream side paper feeding rollers because of the difference between the paper feeding amount of the downstream side paper feeding rollers and that of the upstream side paper feeding rollers.

In addition, the printing speed of the printing head is adjusted to the paper feeding amount of the upstream side paper feeding rollers. When the trailing end of the sheet of paper leaves the upstream side paper feeding the rollers, that is, the upstream side paper feeding rollers finish feeding the paper, the paper feeding amount is insufficient for the printing speed of the printing head because the paper is fed only by the downstream side paper feeding rollers which have the lower amount of paper feeding.

In order to solve these problems associated with the paper feeding amount, the downstream side paper feeding rollers can be made a little larger than that of the upstream side paper feeding rollers. To make the paper feeding amount of the downstream side paper feeding rollers larger than that of the upstream side paper feeding rollers, the diameter of the downstream side paper feeding roller should become longer than that of the upstream side paper feeding rollers. However, since the difference of the diameter of the two rollers must be extremely small, production is difficult and costly. Thus, it is not desirable to process or manufacture the rollers to such close tolerances.

SUMMARY OF THE INVENTION

An object of the invention is to provide a precise paper feeding device using paper feeding rollers of the same shape comprised of a hard member, like metal, capable of obtaining a precise and stable paper feeding accuracy by a simple structure.

To achieve the object in a paper feeding device of a printer having paper feeding means on the upstream and the downstream sides of the paper feeding direction with a printing portion therebetween, the paper feeding means installed on the upstream side and the downstream side of the paper feeding direction comprises a paper feeding roller made from a hard member and a pinch roller made from an elastic member. The pinch roller pressure contacts the paper feeding roller and is rotatable. A loading means gives a predetermined pressure to the pinch roller. The pressure of the pinch roller applied to the paper feeding roller on the downstream side, by said loading means, is set stronger than the pressure of the pinch roller applied to the paper feeding roller on the upstream side, by said loading means.

With an above-mentioned structure, the invention rotates a pair of the paper feeding rollers to feed a paper by sandwiching the paper between a pair of paper feeding rollers made from a hard member and a pair of elastic pinch rollers. The paper feeding rollers are installed on the upstream and downstream sides of the paper feeding direction and rotatable pinch rollers contact the paper feeding rollers with a predetermined pressure. As stated previously, the pressure of the pinch rollers applied to the paper feeding rollers on the downstream side is set stronger than the pressure of the pinch rollers applied to the paper feeding rollers on the upstream side. Therefore, the paper feeding amount on the downstream side in a little bit greater than that of the upstream side and the feed paper is stretched.

It is clear from the above explanation, that the paper feeding amount at the downstream side is a little bit larger than that at the upstream side by making the pressure of the pinch rollers applied to the paper feeding rollers on the downstream side stronger than that of the pinch rollers applied to the paper feeding rollers on the upstream side. Therefore, it is easy to manage the roller parts and the paper feeding device is an extremely simple structure that feeds a paper accurately and stably. Even if the paper leaves the paper feeding rollers on the upstream side, that is, the upstream side paper feeding rollers finish feeding a paper, the paper feeding amount is never insufficient.

BRIEF DESCRIPTION OF THE DRAWINGS

A preferred embodiment of the invention will be described in detail with reference to the following Figures wherein.

DETAILED DESCRIPTION OF THE PREFERRED EMBODIMENT

An embodiment of the invention will be explained with reference to the drawings.

Figure 1:
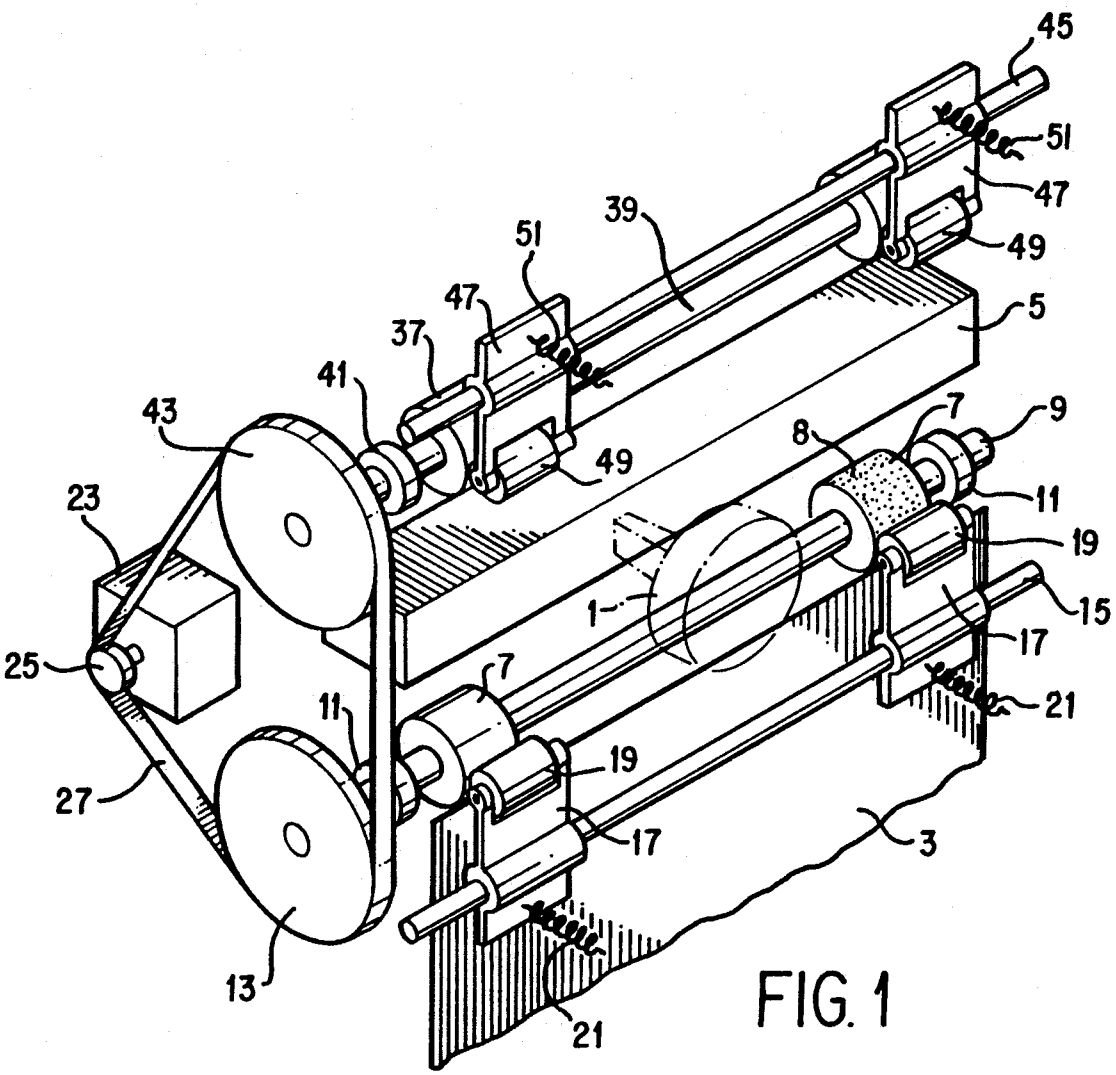
FIG. 1 is a perspective view showing the main construction of the precise paper feeding device of this embodiment.
Figure 2:
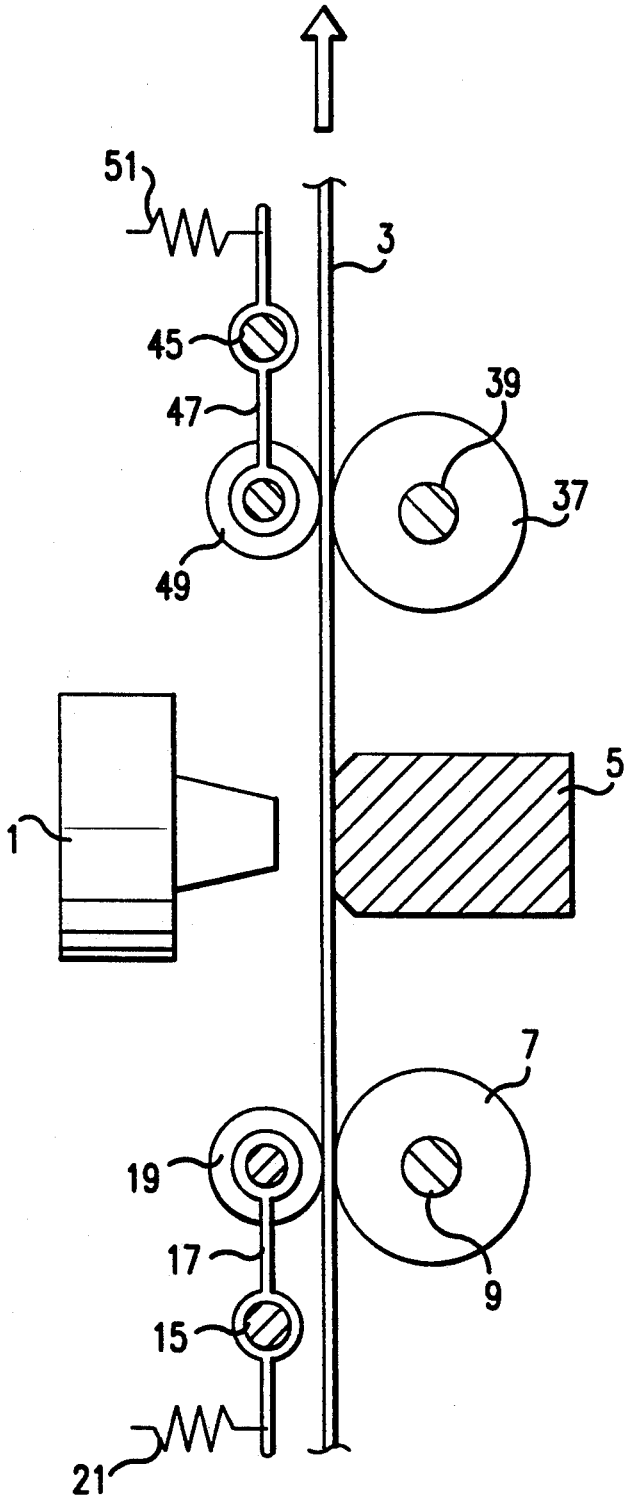
FIG. 2 is a cross-sectional view showing the main structure of the precise paper feeding device of this embodiment.

FIG. 1 is a perspective view and FIG. 2 is a cross-sectional view showing the main structure of the precise paper feeding device of this embodiment. Referring to FIGS. 1 and 2, a printing head 1 prints characters or Figures on a paper 3, with the printing head 1 installed on a carriage (not shown). A platen 5, which supports the paper 3 during printing, is installed in the paper feeding device opposite to the printing head 1 so as to maintain a predetermined space from the printing head 1.

Two upstream side paper feeding rollers 7 are installed on the upstream side, with respect to the paper feeding direction, of the platen 5 and two downstream side paper feeding rollers 37 are installed on the downstream side, with respect to the paper feeding direction, of the platen 5. The upstream side paper feeding rollers 7 and the downstream side paper feeding rollers 37 are made from a hard member, for example, a metal such as aluminum and have a diameter of 21.5 millimeters. Other suitable materials for the paper feeding roller 7, 37 include metal alloys, ceramics and rigid plastics. Alumina powder 8 (shown on one upstream side feeding roller 7) is sprayed and bonded on the surface of the upstream side paper feeding rollers 7 and the downstream side paper feeding rollers 37 to make the friction coefficient with a paper higher. A suitable particle size for the alumina powder is between #800 and #2000. The processing accuracy of rollers made from metal is considerably higher than the processing accuracy of the conventional rollers made from rubber.

Two upstream side paper feeding rollers 7 and two downstream side paper feeding rollers 37 are pressure inserted or bonded to an upstream side roller shaft 9 and a downstream side roller shaft 39, respectively. The two upstream side paper feeding rollers 7 are separated by a predetermined distance as are the two downstream side paper feeding rollers 37. Two upstream side bearings 11, corresponding to the two upstream side paper feeding rollers 7, and two downstream side bearings 41, corresponding to the two downstream side paper feeding rollers 37, are pressure inserted or bonded to the upstream side roller shaft 9 and the downstream side roller shaft 39 respectively. An upstream side pulley 13 and a downstream side pulley 43 are pressure inserted or bonded to an end portion of the upstream side roller shaft 9 and the downstream side roller shaft 39, respectively, in order to rotate the upstream side paper feeding rollers 7 and the downstream side paper feeding rollers 37 by rotating the upstream side roller shaft 9 and the downstream side roller shaft 39.

As the upstream side roller shaft 9 and the downstream side roller shaft 39 are not fixed to the frame (not shown), rather the upstream side bearings 11 and downstream side bearings 41 are fixed to the frame (not shown), the upstream side paper feeding rollers 7 and the downstream side paper feeding rollers 37 can rotate freely by rotating the upstream side roller shaft 9 and the downstream side roller shaft 39. The paper feeding rollers 7, the roller shaft 9, the bearings 11, and the pulley 13 on the upstream side have the same structure, composition and dimensions as the paper feeding rollers 37, the roller shaft 39, the bearings 41, and the pulley 43 on the downstream side. Therefore, it is easy and economical to process and assemble/replace the parts.

On the other hand, an upstream side pinch roller shaft 15 and a downstream side pinch roller shaft 45 are fixed to the frame (not shown). The upstream side pinch roller holders 17 and the downstream side pinch roller holders 47 are pivotably installed on the upstream side pinch roller shaft 15 and the downstream side pinch roller shaft 45, respectively. The rotatable upstream side pinch rollers 19 and the rotatable downstream side pinch rollers 49 are rotatably installed in the upstream side pinch roller holders 17 and the downstream side pinch roller holders 47 respectively.

The upstream side pinch rollers 19 contact the upstream side paper feeding rollers 7 and the downstream side pinch rollers 49 contact the downstream side paper feeding rollers 37 with a predetermined pressure due to the springs 21 installed on the upstream side pinch roller holders 17 and the springs 51 installed on the downstream side pinch roller holders 47, the springs 21, 51 being attached at their other end to the frame (not shown).

The upstream side paper rollers 7 and the downstream side paper rollers 37 are made, as previously discussed, from metal, and the upstream side pinch rollers 19 and the downstream side pinch rollers 49 are made from an elastic member such as rubber, and most preferably of ethylene-propylene-diene rubber (EPDM). Each upstream side pinch roller 19 and downstream side pinch roller 49 is 20 millimeters long and has a diameter of 10 millimeters. Therefore, if the upstream side pinch rollers 19 and the downstream side pinch rollers 49 are in contact with the upstream side paper feeding rollers 7 and the downstream side paper feeding rollers 37, respectively, with pressure applied by the loading of the springs 21, 51, the upstream side pinch rollers 19 and the downstream side pinch rollers 49 made from an elastic member are easily deformed.

The hardness of the rubber of the upstream side pinch rollers 19 and the downstream side pinch rollers 49 is suitable between Hs20° and Hs40° as defined in the Japanese Industrial Standards (JIS). The spring load of the springs 51 on the downstream side is set heavier than that of the springs 21 on the upstream side. That is, the pressure of the downstream side pinch rollers 49 against the downstream side paper feeding rollers 37 is stronger than that of the upstream side pinch rollers 19 against the upstream side paper feeding rollers 7. Therefore, the paper feeding amount of the downstream side is slightly larger than that of the upstream side.

A paper feeding motor 23 is installed on the frame (not shown) and both the upstream side pulley 13 and the downstream side pulley 43 are rotated by the paper feeding motor 23 through a motor pulley 25 and a timing belt 27. The upstream side paper feeding rollers 7 and the upstream side pinch rollers 19 and the downstream side paper feeding rollers 37 and the downstream side pinch rollers 49 rotate with a paper 3 sandwiched between both the upstream side feeding rollers 7 and the upstream side pinch rollers 19 and the downstream side paper feeding rollers 37 and the downstream side pinch rollers 49 to feed the paper 3 when the paper feeding motor 23 rotates the upstream side pulley 13 and the downstream side pulley 43.

The paper feeding amounts of the upstream side paper feeding rollers 7 and the downstream side paper feeding rollers 37 are explained by reference to FIG. 3. First, the upstream side paper feeding rollers 7 and the downstream side paper feeding rollers 37 are made from a metal, metal alloy, or the like, and the upstream side pinch rollers 19 and the downstream side pinch rollers 49 are made from an elastic member. Therefore, when the upstream side pinch rollers 19 and the downstream side pinch rollers 49 are contacted by the upstream side paper feeding rollers 7 and the downstream side paper feeding rollers 37, respectively, with the predetermined pressure loading induced by the springs 21 and 51, the upstream side pinch rollers 19 and the downstream side pinch rollers 49, made from a elastic member, are easily deformed. However, the upstream side paper feeding rollers 7 and the downstream paper feeding rollers 37 made from metal are not deformed.

The paper feeding amount of the paper 3 is determined by the amount of rotation of the upstream side paper feeding rollers 7 and the downstream side paper feeding rollers 37. Particularly, the paper feeding amount of the printing side of the paper 3, that is, the paper feeding amount at the upstream side pinch rollers 19 side and the downstream side pinch rollers 49 side of the paper 3 is important. The paper feeding amount of the upstream side and that of the downstream side are in proportion to the diameter from the center of the upstream side paper feeding roller 7 to the back side of a paper 3 and a diameter from the center of the downstream side paper feeding roller 37 to the printing side of a paper 3 respectively, i.e., at the upstream side paper feeding rollers 7 both the printing and back sides of paper travel at the same velocity as this is no deformation of the pinch rollers 19 whereas at the downstream side feeding rollers 37 the printing side of the paper travels at a slightly greater velocity than the backside due to the deformation of pinch rollers 49 and the increased area of contact transited.

As mentioned before, the pressure applied by the upstream side pinch rollers 19 to the upstream side paper feeding rollers 7 is smaller than the pressure applied by the downstream side pinch rollers 49 to the downstream side paper feeding rollers 37. Because the upstream side pinch rollers 19 just contact the printing side of the paper 3 and the upstream side paper feeding rollers 7 also just contact the back of the paper 3, the upstream side pinch rollers 19 are not deformed, and the paper 3 is not distorted. In this case, the paper feeding amount of the printing side and that of the back of the paper 3 are same. Therefore, the paper feeding amount of the printing side of the paper 3 is determined by the diameter R from the center of the upstream side paper feeding roller 7 to the back of the paper 3.

Figure 3:
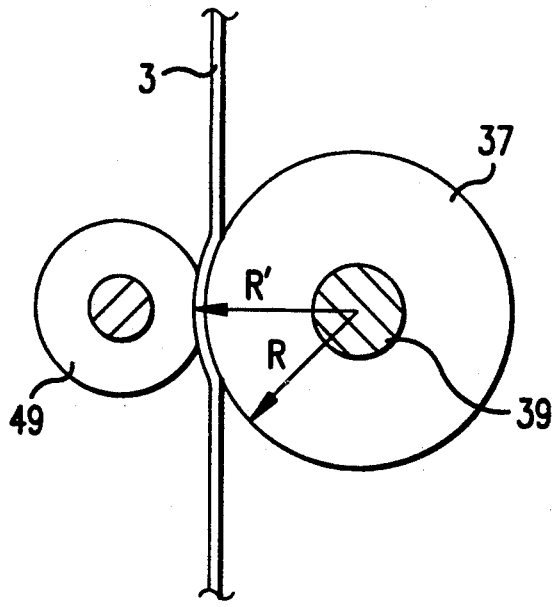
FIG. 3 is a cross-sectional view showing the relationship between the paper feeding roller and the pinch roller for the paper feeding of this embodiment.

On the other hand, since the pressure of the downstream side pinch rollers 49 to the downstream side paper feeding rollers 37 is stronger, the downstream side pinch rollers 49 made from an elastic member are deformed and the paper 3 is distorted as shown in FIG. 3. As shown, diameter R' from the center of the downstream side paper feeding roller 37 to the printing side of the paper 3 is longer than diameter R from the center of the downstream side paper feeding roller 37 to the back of the paper 3. The paper feeding amount of the printing side of the paper 3 on the downstream side is determined by diameter R'.

Because the upstream paper feeding rollers 7 and the downstream side paper feeding rollers 37 installed in the paper feeding device have the same shape, the diameter from the center of the upstream side paper feeding roller 7 to the back of the paper 3 mentioned above is same as the diameter R from the center of the downstream side paper feeding roller 37 to the back of the paper 3. Therefore, the diameter from the center of the upstream side paper feeding roller 7 to the back of the paper 3 is shorter than the diameter R' from the center of the downstream side feeding roller 37 to the printing side of the paper 3. As a result, the paper feeding amount of the upstream side paper feeding rollers 7 is smaller than that of the downstream side paper feeding rollers 37.

As explained above, the paper feeding amount of a paper 3 is different between the upstream side and the downstream side with the same shape of the paper feeding rollers.

The nip pressure PU of the downstream side is stronger than the nip pressure PL of the upstream side in FIG. 2 because the load of downstream side spring 51 is set heavier than the load of the upstream side spring 21. Therefore, the deformation amount of the downstream side pinch rollers 49 is larger than that of the upstream side pinch rollers 19 and the paper feeding amount of the downstream side is slightly larger than that of the upstream side.

Figure 4:
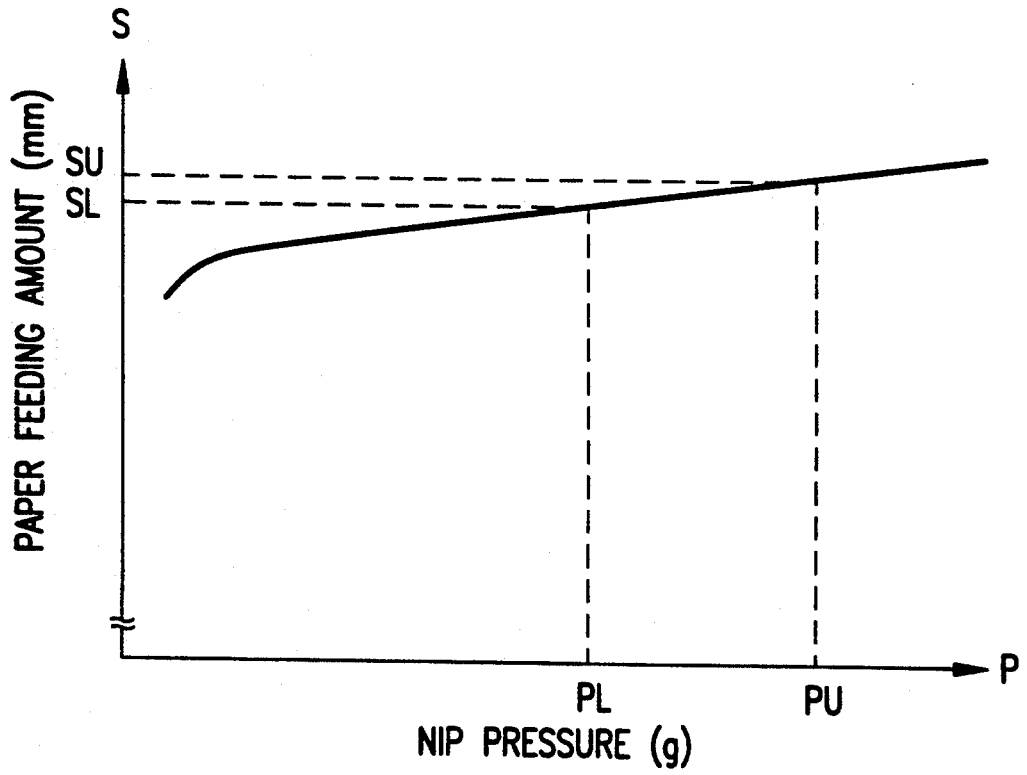
FIG. 4 is a view showing the relationship between the nip pressure and paper feeding amount for the paper feeding of this embodiment.

According to an experiment, it is suitable that the nip pressure PL of the upstream side be set between 700 g–1000 g and the nip pressure PU of the downstream side is set between 1000 g–1500 g so that the nip pressure PU of the downstream side is stronger than the nip pressure PL of the upstream side. At this time, the relationship between the paper feeding amount S and the nip pressure P of the upstream side and the downstream side is shown by the graph in FIG. 4.

For example, when the nip pressure PL of the upstream side is set at 800 g and the nip pressure PU of the downstream side is set at 1200 g, the relationship of the paper feeding amount SL of the upstream side paper feeding rollers 7 to the paper feeding amount SU of the downstream side paper feeding rollers 37 is about 1000:1001. That is, the paper feeding amount SU of the downstream side paper feeding rollers 37 is larger than the paper feeding amount SL of the upstream side paper feeding rollers 7 by about 0.1 percent. Therefore, a paper 3 is always fed stretched, or taut, without any looseness between the upstream and downstream side paper feeding rollers 7, 37 and the paper feeding amount produced by the downstream side paper feeding rollers 37 is enough to continue normal printing operations even after the paper 3 clears the upstream side paper feeding rollers 7, that is, the upstream side paper feeding rollers 7 finish feeding the paper 3.

As explained above, concerning the paper feeding device of this embodiment, the paper feeding amount of the downstream side is a little bit greater than that of the upstream side by making the pressure of the downstream side pinch rollers 49 against the downstream side paper feeding rollers 37 stronger than the pressure of the upstream side pinch rollers 19 against the upstream side paper feeding rollers 7. Therefore, the paper feeding device has a simple structure and it can feed a paper 3 without slack between the paper feeding rollers 7, 37 in an accurate and stable manner. In addition, because the upstream side paper feeding rollers 7 and the downstream side paper feeding rollers 37 are the same, it is easy to manufacture and replace the rollers.

It is to be understood that the invention is not restricted to the particular forms shown in the foregoing embodiment, and the various modifications and alterations can be added thereto without departing from the scope of the invention encompassed by the appended claims.

What is claimed is:

1. A sheet feeding device and a printing apparatus housed in a frame body, the sheet feeding device for feeding along a feeding direction a sheet on which a print is executed at a printing position, comprising:

at least one upstream feeding roller installed on the upstream side of the printing position along a feeding direction;

at least one upstream pinch roller for nipping a sheet with an opposed upstream feeding roller;

an upstream energization means for making the at least one upstream pinch roller and the opposed feeding roller be pressed against each other by an upstream pressure;

at least one downstream feeding roller of the same size as the at lest one upstream feeding roller;

at least one downstream pinch roller of the same size as the at least one upstream pinch roller for nipping a sheet with an opposed downstream feeding roller; and a downstream energization means for making the at least one downstream pinch roller and the opposed downstream feeding roller be pressed against each other by a downstream pressure, wherein said at least one downstream feeding roller and said at least one upstream feeding roller are rigid members, said at least one downstream pinch roller and said at least one upstream pinch roller are elastic members, and a downstream pressure is higher than an upstream pressure as applied between opposed downstream and upstream feed and pinch rollers respectively.

2. A sheet feeding device according to claim 1, wherein the elastic member is made of rubber.

3. The sheet feeding device as claimed in claim 2, wherein said elastic material has a hardness between Hs20° and Hs40° as defined in the Japanese Industrial Standards (JIS).

4. A sheet feeding device according to claim 2, wherein the rigid members are made of metal.

5. The sheet feeding device as claimed in claim 4, wherein said rigid metal members are made only of aluminum.

6. The sheet feeding device as claimed in claim 5, further comprising alumina powder bonded on an outer surface of said rigid metal members.

7. The sheet feeding device according to claim 1, wherein said at least one upstream feeding roller and said at least one downstream feeding roller are all metal members.

8. The sheet feeding device according to claim 7, wherein said at least one upstream feeding roller and said at least one downstream feeding roller are made only of aluminum.

9. The sheet feeding device according to claim 7, wherein said at least one upstream pinch roller and said at least one downstream pinch roller are made of rubber.

10. The sheet feeding device as claimed in claim 9, wherein said rubber has a hardness between Hs 20° and Hs 40° as defined in the Japanese Industrial Standards (JIS).

11. The sheet feeding device as claimed in claim 7, further comprising alumina powder bonded on an outer surface of said at least one upstream feeding roller and said at least one downstream feeding roller.

12. A sheet feeding device for a printer, comprising:

two identical paper feed combinations each further comprising;

a rotatable feed roller shaft rotatably mounted between sides of the printer;

at least two paper feeding rollers fixed to said feed roller shaft;

a pinch roller shaft mounted between the sides of the printer;

at least two pinch roller holders pivotally mounted to said pinch roller shaft, each said pinch roller holder having a pinch roller rotatably mounted thereto, said at least two pinch rollers and said at least two feeding rollers providing at least two pairs of an opposing paper feeding roller and a pinch roller, wherein a first paper feed combination is disposed upstream of a printer platen and a second paper feed combination is disposed downstream of the printer platen in a paper feed direction;

an upstream resilient means for biasing each said pinch roller against said opposed paper feeding rollers of the first paper feed combination; and a downstream resilient means for biasing each said pinch roller against said opposed paper feeding roller by applying a force to each said pinch roller of the second paper feed combination, wherein each of said at least two paper feeding rollers is made only of a non-resilient material and each of said at least two pinch rollers is made of an elastic material and said force applied by said downstream resilient means being greater than a force applied by said upstream resilient means, the force applied by said downstream resilient means causing each said downstream pinching roller to be deformed by contact with said paired feeding roller.

13. The sheet feeding device as claimed in claim 12, wherein said non-resilient material is selected from the group consisting of metals, metal alloys, ceramics, and rigid plastics.

14. The sheet feeding device as claimed in claim 12, wherein said non-resilient material is aluminum.

15. The sheet feeding device as claimed in claim 14, further comprising alumina powder bonded on an outer surface of each said paper feeding roller.

16. The sheet feeding device as claimed in claim 15, wherein said alumina powder has a particle size between #800 and #1200.

17. The sheet feeding device as claimed in claim 12, wherein said elastic material has a hardness between Hs20° and Hs40° as defined in the Japanese Industrial Standards (JIS).

18. The sheet feeding device as claimed in claim 17, wherein said elastic material is rubber.

19. The sheet feeding device as claimed in claim 12, further comprising a particulate covering applied to an outer surface of each said paper feeding roller.

20. The sheet feeding device as claimed in claim 12, wherein the force applied by said upstream resilient means is in the range of 700–1000 grams and the force applied by the downstream resilient means is in the range of 1000–1500 grams.

21. The sheet feeding device as claimed in claim 20, wherein each of said at least two paper feeding rollers has a diameter of 21.5 millimeters and each of said at least two pinch rollers has a length of 20 millimeters, a diameter of 10 millimeters and the elastic material is ethylene propylene-diene rubber.

* * * * *